US008166570B2

(12) United States Patent
Matuszak et al.

(10) Patent No.: US 8,166,570 B2
(45) Date of Patent: May 1, 2012

(54) KNEE PROTECTION SYSTEM

(75) Inventors: Daniel R. Matuszak, Woodland Park, CO (US); Christan Medovich, Woodland Park, CO (US)

(73) Assignee: Woodland Wear, LLC, Colorado Springs, CO (US)

( * ) Notice: Subject to any disclaimer, the term of this patent is extended or adjusted under 35 U.S.C. 154(b) by 818 days.

(21) Appl. No.: 12/214,622

(22) Filed: Jun. 20, 2008

(65) Prior Publication Data

US 2009/0013442 A1 Jan. 15, 2009

Related U.S. Application Data

(63) Continuation-in-part of application No. 11/649,984, filed on Jan. 5, 2007, now abandoned.

(51) Int. Cl.
*A41D 13/00* (2006.01)

(52) U.S. Cl. ..... 2/23

(58) Field of Classification Search ..... 2/23, 22, 2/24, 16, 62, 79, 227, 242, 69, 247, 911; 128/881, 882; 602/23, 26, 61–63
See application file for complete search history.

(56) References Cited

U.S. PATENT DOCUMENTS

| | | | | |
|---|---|---|---|---|
| 4,561,124 | A * | 12/1985 | Thompson | 2/23 |
| 6,289,524 | B1 * | 9/2001 | Wright et al. | 2/455 |
| 6,327,713 | B1 * | 12/2001 | Gomez | 2/227 |
| 6,338,164 | B1 * | 1/2002 | Howard | 2/242 |
| 6,751,804 | B1 * | 6/2004 | Warner et al. | 2/23 |
| 7,089,598 | B2 * | 8/2006 | Sallas et al. | 2/79 |

* cited by examiner

*Primary Examiner* — Tejash Patel
(74) *Attorney, Agent, or Firm* — Dale B Halling

(57) ABSTRACT

The invention is related to a knee protection system having a knee pad permanently attached to a garment such as pants. The pad is made of silicone rubber. The pad may be shaped and have a number of pad areas including a patella covering part of the pad, a pair of side parts and a top part of the pad. The side parts of the pad protect the user when they roll on their knees and the top part of the pad protects the user knee when they lean forward. The silicone rubber pad is waterproof, inert, and fire resistant. The pad is permanently attached to a knee region of a pair of pants. By manufacturing the pad in a pair of pants a user can comfortably walk around with the knee protection system.

11 Claims, 3 Drawing Sheets

KNEE PROTECTION SYSTEM

RELATED APPLICATIONS

The present invention claims priority on and is a continuation-in-part of, Ser. No. 11/649,984, filed on Jan. 5, 2007 now abandoned, entitled "Knee Protection System" and is hereby incorporated by reference.

STATEMENT REGARDING FEDERALLY SPONSORED RESEARCH

Not Applicable

THE NAMES OF THE PARTIES TO A JOINT RESEARCH AGREEMENT

Not Applicable

REFERENCE TO A SEQUENCE LISTING, A TABLE, OR A COMPUTER PROGRAM LISTING

Not Applicable

BACKGROUND OF THE INVENTION

A large number of people have to be on their knees at least part of the time at work, such as carpenters, carpet installers, plumbers, janitors-tile setters, etc. Being on your knees can be painful and make doing your job more difficult and inefficient. One solution has been to wear knee pads like volleyball players. These pads fit over the knee and are made of a soft foam padding encased in a stretchable fabric. Unfortunately, these pads do not fit over pants well, are awkward to walk in, create discomfort to the wearer and do not protect from sharp points and hard surfaces. Another solution has been hard shell knee pads that are held onto the user's legs by an elastic band. Unfortunately, these pads do not fit over pants well and are awkward to walk in. Another solution has been to have pants made with pockets in the knee area. A rectangular piece of foam is placed in the pocket. Unfortunately, foam absorbs water, becomes compacted over time and does not protect from sharp points. In addition, the foam pads have to be removed from the pants before the pants are washed.

Thus, there exists a need for a knee protection system that allows the user to walk comfortably, provides the necessary comfort and protection for the wearer to perform a task or function, has resistance to impact and sharp points and does not induce discomfort.

BRIEF SUMMARY OF INVENTION

A knee protection system that overcomes these and other problems has a garment such as pants with a permanent pad at the knee. The pad is made of silicone rubber. The pad may be shaped and have a number of sub-pads including a patella pad, a pair of side pads and a top pad. The side pads protect the user when they roll on their knees and the top pad protects the user's knees when they lean forward. The silicone rubber pad is waterproof, inert, and fire resistant. By integrating the pads in a pair of pants a user can comfortably walk around with the knee protection system.

DETAILED DESCRIPTION OF THE INVENTION

The invention is related to a knee protection system having a knee pad. The pad is made of silicone rubber. The pad may be shaped and have a number of sub-pads including a patella pad, a pair of side pads and a top pad. The side pads protect the user when they roll on their knees and the top pad protects the user knee when they lean forward. The silicone rubber pad is waterproof, inert, and fire resistant. The pads are permanently attached to a knee region of a pair of pants. By placing the pads in a pair of pants a user can comfortably walk around with the knee protection system.

Figure 1:
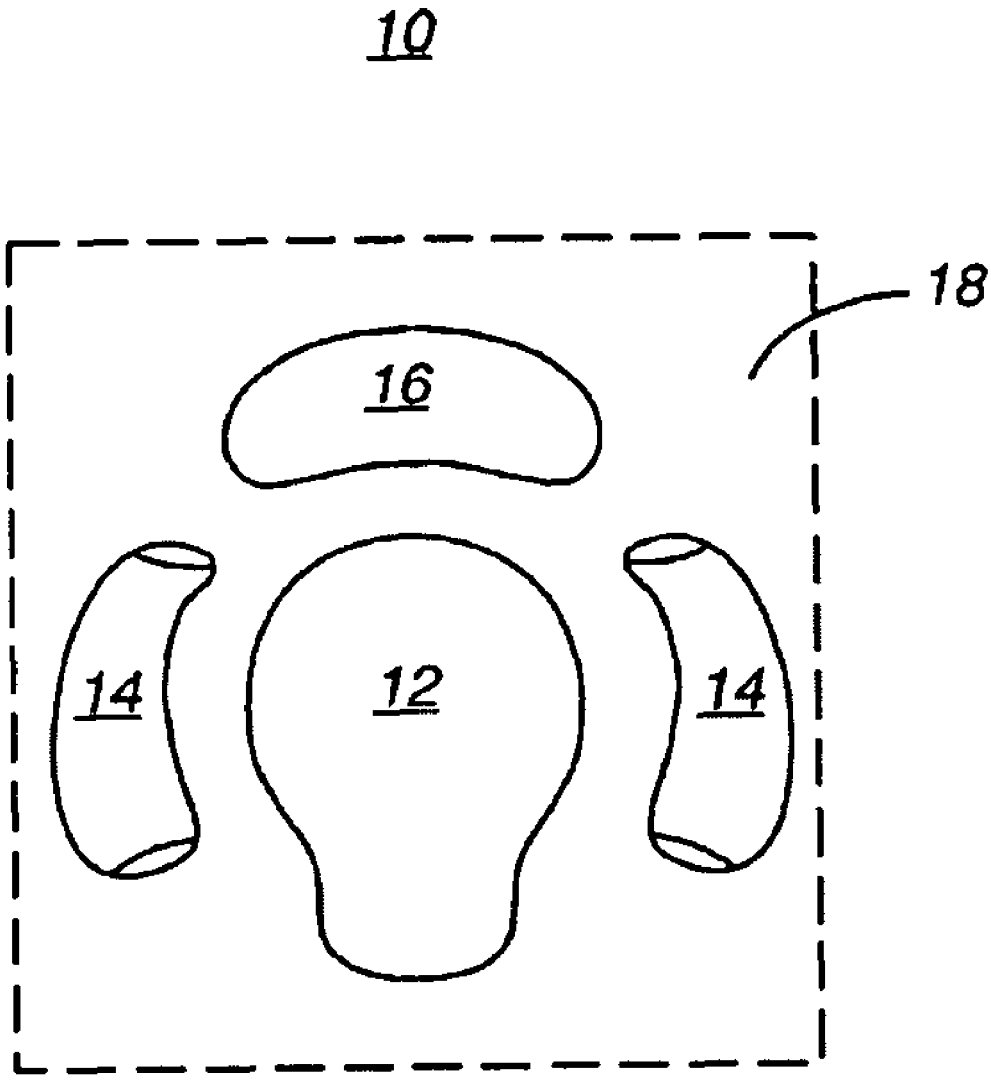
FIG. 1 is a top view of the knee pad in accordance with one embodiment of the invention.

FIG. 1 is a top view of the knee pad 10 in accordance with one embodiment of the invention. The knee pad 10 is made of any suitable elastomeric material, most preferably the material is silicone rubber. Silicone rubber is selected because it is durable, hard enough to protect from sharp points such as nail heads and soft enough to be flexible and move with the user. In addition, silicone rubber is fire retardant and inert. Because it is inert it does not have an odor, it is an electrical insulator and does not exude any oils or residues which could stain the pants. Silicone rubber can be created to have different hardness. In one embodiment, the pad is designed to have a Shore A hardness of 30 or greater. This allows the user to walk on their knees across tacks and other sharp objects without hurting or effecting their knees. The pad 10 has a butterfly shape and is made up of a number of sub-pads. The sub-pads include the patella pad 12, which covers the patella of the knee of the user. Note that the patella pad 12 is not just a rectangle but is shaped to cover the shape of the knee. A pair of side pads 14 are designed to protect the side of the knee either from bumping into something or if the user rolls over onto the side of their knee. A top pad 16 protects the top of the knee from bumps into hard objects and allows the user to lean forward and still have protection. In one embodiment, all the sub-pads 12, 14 & 16 are connected together by an frame 18. The frame 18 is a thinner layer of silicone rubber, which allows the pads to move freely with the user's movements. In another embodiment, each of the sub-pads are permanently affixed to the garment separately. The thickness of the sub-pads 12, 14 & 16 are selected to provide adequate protection with a minimum of weight. In one embodiment, the thickness is between $1/8^{th}$ and ¼ of an inch of material. In one embodiment, the sub-pads are just areas of the overall pad that protect certain regions.

Figure 2:
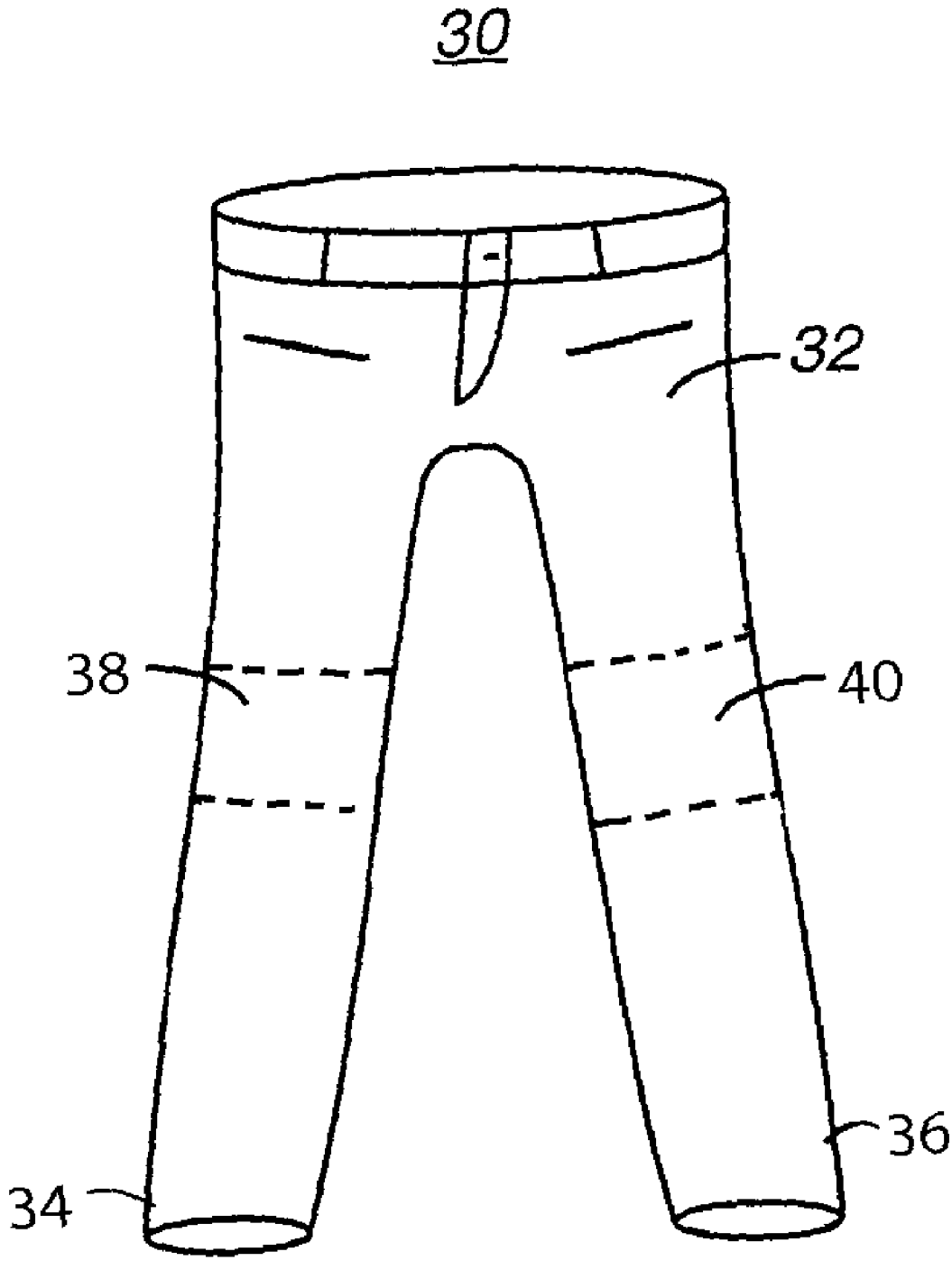
FIG. 2 is a top view of the knee protection system in accordance with one embodiment of the invention.

FIG. 2 is a top view of the knee protection system 30 in accordance with one embodiment of the invention. The knee protection system 30 is a pair of pants 32 made of fabric with a right leg 34 and a left leg 36. The right leg 34 has a right knee area 38 and the left leg 36 has a left knee area 40. A right knee pad similar to the pad 10 of FIG. 1 is permanently affixed to the pants in the right knee area 38. A left knee pad similar to the pad 10 of FIG. 1 is permanently affixed to the pants in the left knee area 40. The pads may be permanently sewn to pants 32 or permanently affixed by glue or any other permanent means of attachment. Because of the pad is permanently attached it cannot fall out or be removed from the pants 32. The silicone rubber material of the pads 10 is selected to be able to withstand the temperature and conditions of the pants being washed and dried in an automatic washer and clothes dryer. A major advantage of the silicone rubber material is that it does not absorb water. This allows the garment to be washed. In addition, when a user does place their knee in water the pad does not continue to be wet as occurs with foam pads.

Figure 3:
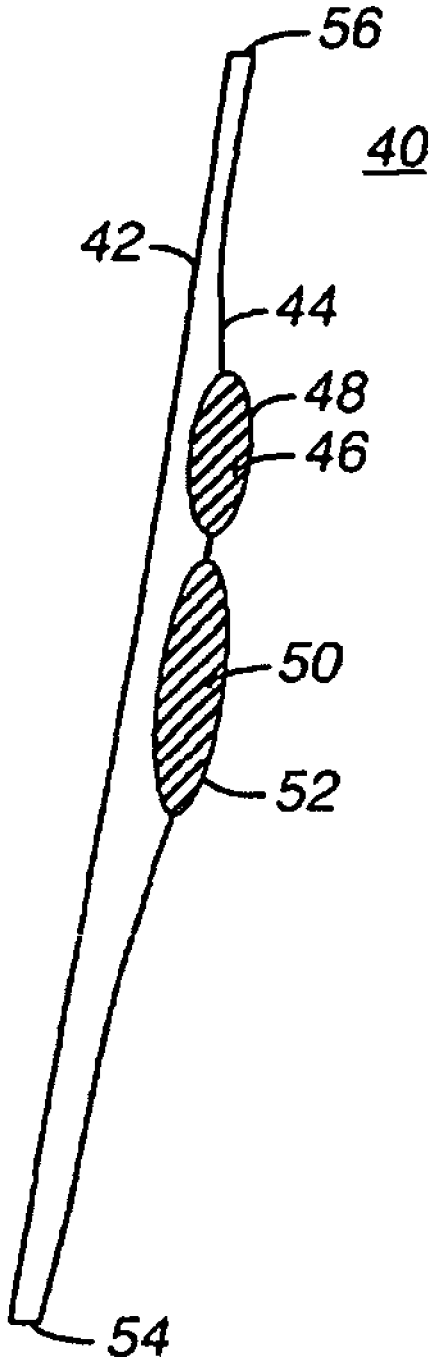
FIG. 3 is a cutaway side view of the knee protection system in accordance with one embodiment of the invention.

FIG. 3 is a cutaway side view of the knee protection system 40 in accordance with one embodiment of the invention. Some users of the knee pad system may require that the pads be hidden. This may be necessary if the user needs a more professional appearance. The knee protection system 40 hides the knee pads so that the pants to all outward appearance do not appear to have a knee pad system. This is accomplished by having an outer cloth layer 42 and an inner cloth layer 44 that is only sewn to the outer layer 42 at normal seam points. The inner layer 44 has a top pad 46 permanently sewn to the inner cloth layer 44. Just below the top pad 46 is the patella pad 50 permanently sewn to the inner cloth layer 44. As a result, the pads 46 & 50 are interior of the outer surface 42 of the fabric. The inner layer 44 is sewn to the outer layer 42 at the hem 54, waistband 56 and to the inseams (not shown). Using this system the pants outward appearance is that of a normal pair of pants. Note that other attachment mechanisms are contemplated, such as gluing the pad to the fabric, heat lamination, plastic welding, etc. All of these attachment mechanisms are incorporated into the invention.

Thus there has been described a knee protection system that is embodied in a garment such as pants. A shaped silicone rubber pad is permanently attached to the knee region of the pants. The shaped pad has a number of sub-pads including a patella pad, a pair of side pads and a top pad. The side pads protect the user when they roll on their knees and the top pad protects the user knee when they lean forward. The silicone rubber pad does not absorb water, can be washed and protects against both sharp points, more general pressure, fire, and electrical shock. Since the pads are part of the pair of pants a user can comfortably walk around with the knee protection system.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A knee protection system, comprising:

a pair of pants made of fabric have a right leg and a left leg, the right leg having a right knee region and the left leg having a left knee region;

a right knee pad permanently affixed to the right knee region of the pair of pants, the right knee pad being interior of an outer surface of the fabric, wherein the right knee pad is a single layer of solid silicone rubber; and a left knee pad permanently affixed to the left knee region of the pair of pants, the left knee pad being interior of the outer surface of the fabric, wherein the left knee pad is a single layer of solid silicone rubber.

2. The system of claim 1, wherein the right knee pad is permanently sewn to the right knee region of the pair of pants and the left knee pad is permanently sewn to the left knee region of the pair of pants.

3. The system of claim 1, wherein the right knee pad is made of a fire retardant material and the left knee pad is made of the fire retardant material.

4. The system of claim 1, wherein the left knee pad and right knee pad has a Shore A hardness greater than 30.

5. The system of claim 1, wherein the right knee pad and left knee pad is made of an inert material.

6. The system of claim 1, wherein the right knee pad and left knee pad has a non-rectangular shape.

7. The system of claim 1, wherein the left knee pad and left knee pad has a plurality of sub-pads.

8. The system of claim 7, wherein one of the plurality of sub-pads is a side pad.

9. The system of claim 1, wherein the pair of pants has no visible seams as a result of the right knee pad and left knee pad.

10. The system of claim 1, wherein the right knee pad and the left knee pad is waterproof.

11. The system of claim 1, wherein the right knee pad and the left kneepad is electrically insulating.

* * * * *